United States Patent [19]

Semp et al.

[11] Patent Number: 4,895,603

[45] Date of Patent: Jan. 23, 1990

[54] APPARATUS AND METHOD FOR IN-PLACE CLEANING AND PRIMING OF A NOZZLE ASSEMBLY

[75] Inventors: Bernard A. Semp; Bernard C. Kiernan; David L. Bilunas; Michael L. Watkins, all of Richmond, Va.

[73] Assignee: Philip Morris Incorporated, New York, N.Y.

[21] Appl. No.: 286,354

[22] Filed: Dec. 19, 1988

[51] Int. Cl.[4] ..... B08B 3/08; B08B 5/04

[52] U.S. Cl. ..... 134/21; 134/22.18; 134/22.19; 134/22.12; 134/22.14; 134/57 R; 134/169 R

[58] Field of Search ..... 134/21, 22.18, 22.19, 134/104.1, 198, 169 R, 22.12, 22.14

[56] References Cited

U.S. PATENT DOCUMENTS

| | | | |
|---|---|---|---|
| 3,146,950 | 9/1964 | Lancaster | 239/128 |
| 3,435,834 | 4/1969 | Cooper | 134/169 R |
| 4,365,585 | 12/1982 | Naylor et al. | 118/302 |
| 4,420,635 | 12/1983 | Washington et al. | 562/555 |
| 4,500,770 | 2/1985 | Vock et al. | 219/121.7 |
| 4,562,099 | 12/1985 | Hinchcliffe | 427/282 |
| 4,763,672 | 8/1988 | Gregory, III | 131/79 |

FOREIGN PATENT DOCUMENTS

| | | |
|---|---|---|
| 0072377 | 6/1978 | Japan . |
| 1314276 | 4/1973 | United Kingdom . |
| 2030894 | 4/1980 | United Kingdom . |
| 2163528 | 2/1986 | United Kingdom . |

OTHER PUBLICATIONS

"New Developments in CIP Practices", Chemical Engineering Progress, Jan. 1985, pp. 39–41.

*Primary Examiner*—Asok Pal
*Assistant Examiner*—Ourmazd Ojan
*Attorney, Agent, or Firm*—Charles B. Smith; Alan D. Smith

[57] ABSTRACT

An apparatus and method for in-place cleaning and priming of an in-place nozzle assembly which in normal operation receives from a reservoir and discharges to a work area a fluid material which tends to leave behind an accumulation of undesired residue. The apparatus includes control means for sequentially actuating for a selected cleaning time period first selectively actuatable means thereby to deliver an effective quantity of the cleaning substance to the nozzle and for actuating for a selected rinsing time period second selectively actuatable means thereby to deliver an effective quantity of the rinsing substance to the nozzle. The apparatus also includes third selectively actuatable means for drawing fluid material from the reservoir and delivering the same to the nozzle for a selected priming time period first to flush out any remaining rinsing substance from the nozzle and then to leave the nozzle primed with the fluid material.

2 Claims, 1 Drawing Sheet

APPARATUS AND METHOD FOR IN-PLACE CLEANING AND PRIMING OF A NOZZLE ASSEMBLY

Background Of The Invention

This invention relates generally to cleaning machinery and, more particularly, to an apparatus and method for cleaning and priming a nozzle assembly while the nozzle assembly is in-place.

Many manufacturing operations use nozzles for directing the flow of a fluid or the like. Often restrictions develop in the channel within the nozzle reducing the flow of fluid. For example, nozzles for applying glue are used in the production of cigarettes to seal the sideseam of a tobacco rod. Typically, as the nozzle is used, dried glue and particles accumulate in the nozzle channel, thereby restricting the flow of glue.

When the glue nozzle is restricted, the reduced glue flow may be insufficient to properly seal the sideseam of the tobacco rod. As a result, tobacco rods may split open and break. A rod which breaks while the rod is within manufacturing machinery will likely stop that machine. Broken rods are rejected by quality control.

It is desirable to clean glue nozzles frequently, while minimizing the time required for the cleaning. The frequent cleaning of glue nozzles reduces the number of broken tobacco rods, thereby increasing manufacturing production and decreasing cost. Quick cleaning of the glue nozzles reduces machine down-time which also increases manufacturing production and decreases cost. Additionally, the quality of the sideseams is improved, which improves the quality of the cigarettes.

Prior to this invention, the cleaning of a glue nozzle required at least the following steps: (1) the glue machine is taken off-line, (2) the glue nozzle is removed from the machine, (3) the glue nozzle is disassembled, (4) the disassembled glue nozzle is cleaned and dried, (5) the glue nozzle is reassembled, (6) the reassembled glue nozzle is installed on the machine, (7) the glue nozzle is adjusted and calibrated by a mechanic and (8) the glue nozzle is primed. Such an operation is highly labor intensive. Moreover, during the time the nozzle is being removed, disassembled, cleaned, reassembled, installed, adjusted and calibrated, the glue machine is out of operation. As a result, nozzle cleaning is costly, time consuming and reduces cigarette production.

It will be appreciated from the foregoing that an apparatus and method which quickly cleans and primes a nozzle assembly while the nozzle assembly is in-place is a needed improvement. The present invention fulfills this need.

SUMMARY OF THE INVENTION

The present invention is embodied in a cleaning and priming apparatus and method for in-place cleaning and priming of an in-place nozzle assembly which in normal operation receives from a reservoir and discharges to a work area a fluid material which tends to leave behind an accumulation of undesired residue. One of many applications for the apparatus and method is the in-place cleaning and priming of a glue nozzle assembly.

First selectively actuatable means interconnects a source of fluid cleaning substance and the nozzle. Second selectively actuatable means interconnects a source of fluid rinsing substance and the nozzle.

Control means are provided for sequentially actuating the first selectively actuatable means for a selected cleaning time period and the second selectively actuatable means for a selected rinsing time period. While actuated, the first selectively actuatable means delivers an effective quantity of the cleaning substance to the nozzle to remove from the interior of the nozzle any of the fluid material and the undesired residue present therein. The second selectively actuatable means delivers, while actuated, an effective quantity of the rinsing substance to the nozzle to remove from the interior of the nozzle any residue of the cleaning substance present therein.

Third selectively actuatable means interconnects the reservoir and the nozzle for drawing fluid material from the reservoir and delivering the fluid material to the nozzle for a selected priming time period. The fluid material flushes out any remaining rinsing substance from the nozzle and leaves the nozzle primed with the fluid material.

Selectively actuatable priming means is actuated by priming control means for the selected priming time period. While the priming means is actuated, rinsing substance is channeled from the source of fluid rinsing substance through the priming means thereby creating a suction which is applied to the reservoir through the nozzle and actuating the third selectively actuatable means to prime the nozzle with the fluid material.

A waste receiver receives all of the fluid material, the undesired residue, the cleaning substance and the rinsing substance flowing from the nozzle while in an operable position, and all of the rinsing substance channeled through the priming means. The waste receiver is movable out of the operable position to permit normal operation of the nozzle.

The cleaning and priming apparatus includes means operable selectively to connect the cleaning and priming apparatus to the nozzle and to disconnect the cleaning and priming apparatus from the nozzle to permit normal operation of the nozzle after a cleaning and priming operation.

The invention covers both a portable and nonportable clean in-place unit.

In accordance with the invention, the cleaning and priming of the in-place nozzle is performed quickly, in approximately eight minutes for the preferred embodiment described herein, while the nozzle remains in its on-line position. By performing these operations without removing, disassembling, reassembling, installing and calibrating the nozzle, the cost of cleaning due to labor and machine downtime is reduced. Additionally, because the cost of cleaning is reduced, cleaning can be performed more frequently, thereby decreasing the frequency of tobacco rod splitting and breaking.

BRIEF DESCRIPTION OF THE DRAWINGS

The above and other aspects and advantages of the present invention will become apparent from the following description of the preferred embodiment, taken in conjunction with the accompanying drawing which is a block diagram of a portable clean in-place apparatus with dotted lines to show the portable unit connected to an in-place nozzle assembly.

DESCRIPTION OF THE PREFERRED EMBODIMENT

Figure 1:
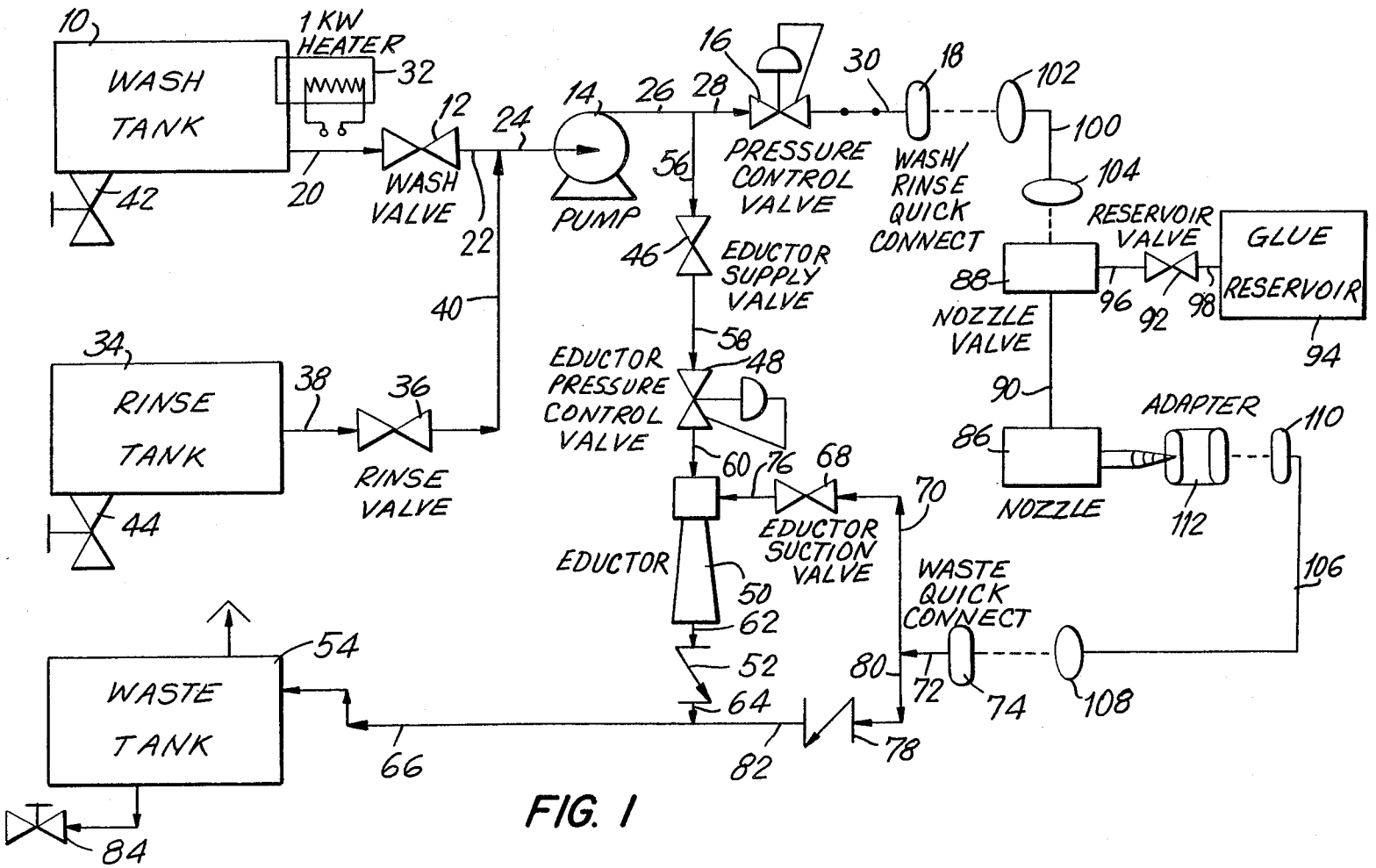

As illustrated in the drawing, the apparatus includes a wash section which comprises a wash tank 10, a wash valve 12, a pump 14, a pressure control valve 16 and a wash/rinse quick connect 18 interconnected by tubing segments 20, 22 and 24, 26 and 28, 30, respectively. The wash tank 10 (made of stainless steel) holds wash fluid. A 1 kilowatt heater 32 is coupled to the wash tank 10 for heating the wash fluid. The wash valve 12 can be switched into either an open position to permit wash fluid to flow from the wash tank 10 or a closed position.

The apparatus also includes a rinse section which comprises a rinse tank 34, a rinse valve 36, the pump 14, the pressure control valve 16, and the wash/rinse quick connect 18 interconnected by tubing segments 38, 40 and 24, 26 and 28, 30, respectively. The rinse tank 34 (made of polypropylene) holds rinse fluid which can flow from the rinse tank 34 when the rinse valve 36 is switched to an open position from a closed position.

Both the wash tank 10 and rinse tank 34 have a drain valve, wash drain valve 42 and rinse drain valve 44, respectively.

Additionally, the apparatus includes a priming section which comprises the rinse tank 34, the rinse valve 36, the pump 14, an eductor supply valve 46, an eductor pressure control valve 48, an eductor 50, a check valve S2 and a waste tank 54 interconnected by tubing segments 38, 40 and 24, 26 and 56, 58, 60, 62, 64 and 66, respectively. Eductors are commercially available, e.g., the Fisher Scientific Spectrum Aspirator Pump and Fisher Scientific Nalgene Vacuum Pump. An eductor suction valve 68 is also included in the priming section. The eductor suction valve 68 is connected by tubing segments 70 and 72 to a waste quick connect 74 and by tubing segment 76 to the eductor 50. The eductor suction valve 68 can be switched to either an open or closed position. Both the eductor supply valve 46 and the eductor suction valve 68 have an open and closed position.

The apparatus further includes a waste section which comprises the waste quick connect 74, a check valve 78 and the waste tank 54 (made of polypropylene) interconnected by tubing segments 72 and 80, 82 and 66, respectively. The waste tank 54 has a waste drain valve 84 for emptying waste fluid collected in the waste tank 54.

The portable clean in-place unit can be connected to an in-place sideseam glue nozzle assembly for cleaning and priming. Although the description herein is with reference to a portable unit, this invention also contemplates a nonportable clean inplace unit.

The in-place sideseam glue nozzle assembly comprises an in-place nozzle 86 connected to a nozzle valve 88 by tubing segment 90. The nozzle valve 88 is also connected to a reservoir valve 92 and a glue reservoir 94 by tubing segments 96 and 98, respectively. The reservoir valve 92 is switchable between an open position to permit the flow of glue from the glue reservoir 94 and a closed position.

The portable clean in-place unit is connected to the in-place nozzle assembly by two hoses and an adapter. An input hose 100 with connectors 102 and 104 is connected to the wash/rinse connector 18 and to the nozzle valve 88, respectively. An output hose 106 with connectors 108 and 110 is connected to the waste connector 74 and an adapter 112, respectively. The adapter 112 is handscrewed onto the exit of the in-place nozzle 86 and is suction tight.

The nozzle valve 88 has two positions: (i) a clean position which permits the selective flow of wash fluid and rinse fluid from the wash/rinse connector 18 to the in-place nozzle 86 and prevents the flow of glue from the glue reservoir 94 to the in-place nozzle 86 and (ii) a primer position which permits the flow of glue from the glue reservoir 94 to the in-place nozzle 86 and prevents the flow of wash fluid and rinse fluid from the wash-/rinse connector 18 to the in-place nozzle 86.

The method of this invention and the operation of the clean in-place unit will be described with reference to the drawing. The cleaning and priming operation consists of three cycles: a wash cycle, a rinse cycle and a priming cycle.

Prior to commencing the wash cycle, the wash tank 10, rinse tank 34, and waste tank 54 are prepared. The wash tank 10 and rinse tank 34 are filled with water after the wash drain valve 42 and rinse drain valve 44 are closed. Preferably, the water added to the wash tank 10 is warm. This decreases the time necessary to heat the wash fluid. Detergent is also added to the wash tank 10. If any waste fluid is present in the waste tank 54, the waste fluid is drained by opening the waste drain valve 84. After draining, the waste valve 84 is closed.

After the wash tank 10 is filled and capped, the heater 32 is activated. The clean in-place unit must be connected to a suitable power source. The wash fluid is heated to approximately 160° F. Heated wash fluid cleans the in-place glue nozzle 86 better and faster.

Once the tanks have been prepared and the wash fluid heated, the clean in-place unit is ready to be moved to an in-place nozzle assembly for in-place cleaning and priming. The unit should be plugged into a suitable power source at the cleaning site, e.g., a 120 volt AC power line.

Once the clean in-place unit is in position, the sideseam glue nozzle to be cleaned is turned off and the clean in-place unit is connected to the nozzle assembly. A nozzle adapter 112 is handthreaded (suction tight) onto the exit of the in-place nozzle 86. Then, the output hose 106 is connected to the nozzle adapter 112 and the waste quick connect 74 by connectors 110 and 108, respectively. The input hose 100 is connected to the wash/rinse quick connect 18 and the nozzle valve 88 by connectors 102 and 104, respectively. The reservoir valve 92 is switched to the closed position to stop the flow of glue to the in-place nozzle 86 and the nozzle valve 88 is switched to the clean position.

During the wash cycle, warm wash fluid is pumped from the wash tank 10, to the in-place nozzle 86, via the wash valve 12 (switched to an open position), the pump 14, the pressure control valve 16, the wash/rinse connector 18, the connector 102, the connector 104, the nozzle valve 88 and the interconnecting tube segments 20, 22, 24, 26, 28, 30, 100, 90. The warm wash fluid is pumped through the in-place nozzle 86 and exits the nozzle tip. This cleans glue, debris and other undesired residue from the nozzle channel. The wash fluid exiting the in-place nozzle 86 continues to the waste tank 54 via the adapter 112, the connector 110, the connector 108, the waste connector 74, the check valve 78 and the interconnecting tubing segments 106, 72, 80, 82, 66. The other valves are closed during the wash cycle: the rinse valve 36, eductor supply valve 46, reservoir valve 92, and eductor suction valve 68.

The clean in-place unit wash cycle for the suggested application has been found to be about two minutes. The bulk of the glue should be displaced within the first minute of the wash cycle.

The wash cycle is followed by the rinse cycle. Rinse fluid is pumped from the rinse tank 34, to the in-place nozzle 86, through the rinse valve 36 (switched to an open position), the pump 14, the pressure control valve 16, the wash-rinse connector 18, the connector 102, the connector 104, the nozzle valve 88 and the interconnecting tubing segments 38, 40, 24, 26, 28, 30, 100, 90. The nozzle valve 88 remains in the same clean position during the rinse cycle as during the wash cycle. The rinse fluid is pumped through the in-place nozzle 86 and exits the nozzle tip. This flushes the nozzle of wash fluid. The rinse fluid exiting the in-place nozzle 86 continues to the waste tank 54 via the adapter 112, the connector 110, the connector 108, the waste connector 74, the check valve 78 and the interconnecting tubing segments 106, 72, 80, 82, 66. During the rinse cycle, the wash valve 12, eductor supply valve 46, reservoir valve 92 and eductor suction valve 68 are closed.

The rinse cycle for the suggested application has been found to be approximately three minutes.

The priming cycle starts after the rinse cycle has been completed. The priming cycle evacuates the rinse fluid from the in-place nozzle 86 and primes the nozzle 86 with fresh glue. Before activating the eductor 50 and the pump 14, the nozzle valve 88 is switched to its primer position (open to permit the flow of glue from the glue reservoir 94 and closed to prevent the flow of wash and rinse fluid from the wash/rinse connector 18), the reservoir valve 92 is switched open, the eductor supply valve 46 is switched open, and the eductor suction valve 68 is switched open. The wash valve 12 remains closed and the rinse valve 36 remains open.

During the priming cycle, rinse fluid is pumped by the pump 14 through the eductor 50 creating a low pressure which draws glue through the in-place nozzle 86. Rinse fluid is pumped from the rinse tank 34, through the rinse valve 36, the pump 14, the eductor supply valve 46, the eductor pressure control valve 48, the eductor 50, the check valve 52 and into the waste tank 54 via interconnecting tubing segments 38, 40, 24, 26, 56, 58, 60, 62, 64, 66. The pumping of rinse fluid through the eductor 50 draws glue from the glue reservoir 94, through the reservoir valve 92, the nozzle valve 88, the in-place nozzle 86 and the interconnecting tubing segments 98, 96, 90. As the glue is drawn through the in-place nozzle 86, the glue pushes out any remaining rinse fluid and leaves the nozzle 86 primed with fresh glue. The left over rinse fluid and glue continue to be drawn through the adapter 112, the connector 110, the connector 108, the waste connector 74, the eductor suction valve 68 and interconnecting tubing segments 106, 72, 70, 76, to the eductor 50 where they mix with rinse fluid and are pumped to the waste tank 54.

The priming cycle for the suggested application lasts approximately three minutes. Of course, it is understood that this invention contemplates the use of wash cycles, rinse cycles and priming cycles of different time durations than used by this preferred embodiment. The choice of cycle duration may be influenced by such considerations as the composition of the glue, the cleaning detergent used, the temperature of the wash fluid and the length of time since the nozzle was last cleaned.

After the priming cycle has been completed, the clean in-place unit is disconnected from the nozzle assembly, leaving the in-place nozzle clean, primed and ready for on-line production after about eight minutes. To disconnect the clean in-place unit, the input hose 100 and the output hose 106 are disconnected. The nozzle adapter 112 is then removed from the in-place nozzle 86. The portable clean in-place unit is now ready to be moved to the next service site. The hoses 100 and 106 and the nozzle adapter 112 should be cleaned periodically.

The timing of the operation of the clean in-place unit' is controlled by timers and relay switches of conventional design and operation. These devices (which are not shown) cause the valves to switch position at the proper time and cause the pump 14 and the eductor 50 to activate at the proper time. It is recognized that control of the operation could also be performed manually by an operator or by the use of a microprocessor or the like.

Pressure gauges can be disposed throughout the clean in-place unit to monitor fluid pressures for malfunctions and potential failures.

Additionally, level indicators can be installed in the wash tank, rinse tank and waste tank. And a temperature indicator for the wash tank can be installed.

In addition, the glue reservoir 94 could be cleaned by changing the nozzle valve 88 from a two-way valve to a three-way valve to permit wash and rinse fluid to flow to the glue reservoir 94.

The preferred embodiment has been described with reference to the cleaning of nozzles and specifically, the cleaning of glue from nozzles. This invention also contemplates the cleaning and priming of channels within other devices. Moreover, this invention can be used to clean materials other than glue.

Although the invention has been described in detail with reference to its presently preferred embodiment, it will be understood by one of ordinary skill in the art that various modifications can be made without departing from the spirit and scope of the invention. Accordingly, it is not intended that the invention be limited, except by the appended claims.

We claim:

1. A method for in-place cleaning and priming of an in-place nozzle assembly which in normal operation receives from a reservoir and discharges to a work place a fluid material which tends to leave behind an accumulation of undesired residue, comprising the steps of:

(a) delivering an effective quantity of a fluid cleaning substance from a fluid cleaning source to said nozzle to remove from the interior of said nozzle any of said fluid material and said undesired residue present therein; then (b) delivering an effective quantity of a fluid rinsing substance from a fluid rinsing source to said nozzle to remove from the interior of said nozzle any residue of said cleaning substance present therein; then (c) channeling a quantity of said rinsing substance through priming means to create a suction and applying said suction to said reservoir through said nozzle to draw a quantity of said fluid material from said reservoir and through said nozzle to displace the remainder of said rinsing substance therefrom and effectively to prime said nozzle with said fluid material; and (d) conveying to a waste receiving facility all of said fluid material, said undesired residue, said cleaning substance and said rinsing substance flowing from said nozzle and all of said rinsing substance channeled through said priming means during the conduct of steps (a), (b) and (c) hereof.

2. The method of claim 6, in which said method includes the additional step of disconnecting said cleaning and priming apparatus from said nozzle to permit normal operation of said nozzle after conduct of steps (a), (b), (c) and (d) hereof.

* * * * *